US008499830B2

(12) United States Patent
Alberty

(10) Patent No.: US 8,499,830 B2
(45) Date of Patent: Aug. 6, 2013

(54) METHOD TO DETECT CASING POINT IN A WELL FROM RESISTIVITY AHEAD OF THE BIT

(75) Inventor: Mark William Alberty, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 310 days.

(21) Appl. No.: 12/168,703

(22) Filed: Jul. 7, 2008

(65) Prior Publication Data

US 2010/0000729 A1 Jan. 7, 2010

(51) Int. Cl.
*E21B 47/09* (2012.01)

(52) U.S. Cl.
USPC ..... 166/254.1; 166/250.13; 166/250.04; 175/40

(58) Field of Classification Search
USPC ..... 702/6, 9; 324/323–375; 367/25–35; 166/250.01, 254.2; 175/40, 45, 50
See application file for complete search history.

(56) References Cited

U.S. PATENT DOCUMENTS 2,214,674 A 1/1938 Hayward
3,785,446 A 1/1974 Fertl et al.
4,442,011 A 4/1984 Thaler et al.
4,447,338 A 5/1984 Lundberg et al.
5,508,616 A 4/1996 Sato et al.
RE35,386 E * 12/1996 Wu et al. ..... 175/45
5,720,355 A 2/1998 Lamine et al.
5,881,310 A 3/1999 Airhart et al.
5,963,037 A * 10/1999 Brady et al. ..... 324/338
6,006,844 A 12/1999 Van Puymbroeck et al.
6,272,434 B1 8/2001 Wisler et al.
6,480,118 B1 11/2002 Rao
6,556,014 B1 4/2003 Kong et al.
6,580,068 B1 6/2003 Tarver, III et al.

(Continued)

FOREIGN PATENT DOCUMENTS

GB 2256715 A 12/1992
WO 93/07514 4/1993

(Continued)

OTHER PUBLICATIONS

PCT International Search Report and the Written Opinion dated Dec. 18, 2009 for International Application No. PCT/US2009/049702.

(Continued)

*Primary Examiner* — Kenneth L Thompson
*Assistant Examiner* — James Sayre
(74) *Attorney, Agent, or Firm* — Barbara A. Fisher

(57) ABSTRACT

Methods are described using resistivity measurements obtained while drilling one or more offset wells using a drilling mud to guide drilling of one or more uncased intervals of a well to identify a casing point or points in the uncased intervals of the well. Resistivity data is gathered during drilling the offset well and prior to penetrating a region of interest of a known subterranean formation. The drill string in the uncased interval of the well progresses toward the region of interest, using resistivity data at similar depths to identify a casing point while the drill bit advances toward but does not penetrate the region. In certain embodiments resistivity may also be obtained in front of the drill bit in the uncased interval of the well and used in conjunction with the offset well resistivity data to identify casing points in the uncased intervals of the well.

13 Claims, 11 Drawing Sheets

U.S. PATENT DOCUMENTS

| | | | | |
|---|---|---|---|---|
| 6,856,909 | B2 | 2/2005 | Banning-Geertsma | |
| 7,023,213 | B2 | 4/2006 | Nichols | |
| 7,066,282 | B2 | 6/2006 | Chen et al. | |
| 7,202,669 | B2 | 4/2007 | Ellingsrud et al. | |
| 7,203,599 | B1 | 4/2007 | Strack et al. | |
| 7,307,424 | B2 | 12/2007 | MacGregor et al. | |
| 7,310,580 | B2 | 12/2007 | Zhou et al. | |
| 2002/0149498 | A1 | 10/2002 | Tabanou et al. | |
| 2003/0151975 | A1* | 8/2003 | Zhou et al. | 367/31 |
| 2004/0236513 | A1 | 11/2004 | Tutuncu et al. | |
| 2005/0067190 | A1 | 3/2005 | Tabanou et al. | |
| 2005/0092487 | A1 | 5/2005 | Banning et al. | |
| 2005/0093546 | A1 | 5/2005 | Banning et al. | |
| 2005/0257960 | A1* | 11/2005 | McGregor et al. | 175/24 |
| 2006/0038571 | A1 | 2/2006 | Ostermeier et al. | |
| 2006/0055411 | A1 | 3/2006 | Banning et al. | |
| 2006/0061363 | A1 | 3/2006 | Banning et al. | |
| 2006/0061364 | A1 | 3/2006 | Banning et al. | |
| 2007/0108981 | A1 | 5/2007 | Banning-Geertsma et al. | |
| 2007/0127314 | A1* | 6/2007 | Wang et al. | 367/41 |
| 2007/0216416 | A1 | 9/2007 | Itskovich | |
| 2007/0256832 | A1 | 11/2007 | Hagiwara et al. | |
| 2007/0285274 | A1 | 12/2007 | Esmersoy | |
| 2009/0260878 | A1* | 10/2009 | Morley et al. | 175/45 |
| 2010/0000791 | A1 | 1/2010 | Alberty | |
| 2010/0000792 | A1 | 1/2010 | Alberty | |

FOREIGN PATENT DOCUMENTS

| | | | |
|---|---|---|---|
| WO | 97/05361 | | 2/1997 |
| WO | 9705361 | A1 | 2/1997 |
| WO | 99/00575 | | 1/1999 |
| WO | 00/00849 | | 1/2000 |
| WO | 00/00850 | | 1/2000 |
| WO | 2004/113674 | A1 | 12/2004 |
| WO | 2004113674 | A1 | 12/2004 |
| WO | 2007/022116 | A1 | 2/2007 |

OTHER PUBLICATIONS

PCT Partial Search Report (Annex to Invitation to Pay Additional Fees) dated Dec. 2, 2009 for International Application No. PCT/US2009/049706.

PCT International Search Report dated Dec. 17, 2009 for International Application No. PCT/US2009/049709.

Eaton, B. A, "The Effect of Overburden Stress on Geopressure Prediction from Well Logs", J. Petrol. Tech., Aug. 1972, pp. 929-934, SPE-AIME.

Banning, et al., "Imaging of a subsurface conductivity distribution using a time-domain electromagnetic . . . ",SEG/San Antonio 2007 Ann. Mtg, pp. 648-652, SEG, USA.

Hottmann, et al., "Estimation of Formation Pressures from Log-Derived Shale Properties", J. of Petrol. Tech., Jun. 1965, pp. 717-722, USA.

Omeragic, et al., "Deep Directional Electromagnetic Measurements for Optimal Well Placement", SPE 97045, 2005, pp. 1-12, Society of Petrol. Engrs., USA.

Lindom, et al., "Electromagnetic Prospect Scanning—Seabed Logging Moves From Risk Reduction to Value Creation", SPE 108631, 2007, pp. 1-6, Society of Petrol. Engrs., USA.

Abubakar, et al., "A Two-and-Half-Dimensional Model-Based Inversion Algorithm for the Controlled-Source Electromagnetic Data", SPE 110054, 2007, Society of Petrol. Engrs., USA.

Chandola, et al.,"Challenges in Shallow Water CSEM Surveying: A Case History from Southeast Asia", IPTC 11511, 2007, pp. 1-5, Int. Petrol. Tech. Conf., Dubai, UAE.

Gianzero, et al., "A New Resistivity Tool for Measurement-While-Drilling", SPWLA Twenty-Sixth Ann. Logging Symposium, Jun. 17-20, 1985, pp. 1-22, SPWLA, USA.

PCT Partial Search Report (Annex to Invitation to Pay Additional Fees) dated Nov. 12, 2009 for International Application No. PCT/US2009/049709.

PCT International Search Report and the Written Opinion dated Feb. 12, 2010 for International Application No. PCT/US2009/049706.

Non-Final Office Action in U.S. Appl. No. 12/168,628, Mar. 18, 2011, including list of references, examiner's search strategy and results, search information including classification, databases and other search related notes, and list of references cites by applicant and considered by examiner, p. 1-21.

PCT International Preliminary Report on Patentability, International application No. PCT/US2009/049709, Jan. 11, 2011, p. 1-8.

Andrew D.K. Brehm and Chris D. Ward, "Pre-drill Planning Saves Money", E&P, May 1, 2005, 4 pages, http://www.epmag.com/archives/print/2013.htm.

Ben A. Eaton, "The Equation for Geopressure Prediction From Well Logs", Society of Pretroleum Engineers of Aime, SPE 5544, 1975, American Institute of Mining, Metallurgical, and Petroleum Engineers, Inc., 11 pages.

* cited by examiner

METHOD TO DETECT CASING POINT IN A WELL FROM RESISTIVITY AHEAD OF THE BIT

CROSS-REFERENCE TO RELATED APPLICATIONS

The present application is related to U.S. application Ser. Nos. 12/168,659 and 12/168,628, filed on even date herewith, and which are incorporated herein by reference in their entirety.

BACKGROUND INFORMATION

1. Technical Field

The present disclosure relates in general to methods of drilling wellbores, for example, but not limited to, wellbores for producing hydrocarbons from subterranean formations, and more particularly to methods of using resistivity data to identify a casing point in a well being drilled using formation resistivity markers obtained from resistivity measurements obtained while drilling one or more subterranean offset wells to identify one or more casing points in the wellbore being drilled while the drill bit advances toward but does not penetrate the formation while drilling the wellbore.

2. Background Art

Formation resistivity measurements are commonly made in oil and gas wells and then used to make decisions about the presence of hydrocarbons, the magnitude of pore pressure, the correlation to formations observed in offset wells, the salinity of formation fluids, porosity of formations, and the presence of permeability. FIG. 1 illustrates graphically the prior art concept of measuring resistivity as a function of depth, showing a typical decrease in resistivity at a depth where increased geopressure (pore pressure) exists (from Eaton, "The Effect of Overburden Stress on Geopressure Prediction From Well Logs", SPE 3719 (1972)). In shale rocks, resistivity data points diverge from the normal trend toward lower resistivity values, owing to high porosity, overpressured formations.

Existing techniques to measure resistivity are made after the bit penetrates the formation using either electric line logging methods or logging while drilling methods. In either case the formation of interest has already been exposed to the well in order to make the resistivity measurement. This exposure presents problems, including the fact that the condition of the borehole itself and surrounding disturbed formation will have an effect on the very resistivity values being sought, as noted by Hottman et al., "Estimation of Formation Pressures From Log-Derived Shale Properties", SPE 1110 (1965).

Banning et al. discuss a theoretical application of time-domain electromagnetics (TEM) in a borehole-conveyed logging tool. Banning et al., "Imaging of a subsurface conductivity distribution using a time-domain electromagnetic borehole conveyed logging tool", Society of Exploration Geophysicists, San Antonio Annual Meeting (2007). See also Published U.S. Patent applications numbers 2005/0092487; 2005/0093546; 2006/003857; 2006/0055411; 2006/0061363; 2006/0061364, and U.S. Pat. No. 6,856,909. Banning et al. state that, theoretically, such a tool may be used to image the conductivity distribution around and ahead of the drill bit at comparatively large distances from the borehole. However, Banning et al. do not disclose or suggest use of resistivity measurements in front of a drilling bit to identify a casing point in a wellbore being drilled, while the drill bit advances in the wellbore being drilled toward but does not penetrate a region of interest in the formation, using formation resistivity markers obtained from resistivity measurements obtained while drilling one or more subterranean offset wells. Banning et al. also do not disclose or suggest using resistivity in front of the bit measurements in the wellbore being drilled, in addition to resistivity measurements obtained from the one or more offset wells, to identify casing points in the wellbore.

It is known in wellbore planning and drilling operations to study data from offset wells to develop and validate geomechanical stress models, and adjust casing points and mud weights to meet well challenges. See for example Brehm et al., "Pre-drill Planning Saves Money", E & P, May 2005. An offset well is an existing wellbore close to a proposed well that provides information for planning the proposed well. In planning development wells, there are usually numerous offsets, so a great deal is known about the subsurface geology and pressure regimes. A casing point is a location, or depth, at which drilling an interval of a particular diameter hole ceases, so that casing of a given size can be run and cemented. Establishing correct casing points is important in the design of the drilling fluid program. Conventionally, a casing point may be a predetermined depth, or it may be determined by a pressure hunt, selected onsite according to geological observations or dictated by problems in the open hole section. In many cases, weak or underpressure zones must be protected by casing to enable mud-weight adjustments that control unstable formations or overpressure zones deeper in the wellbore. A pressure hunt is used to evaluate various well parameters to identify when the pore pressure in a drilling well is changing. The purpose is to detect the pore pressure transition (usually from lower to higher pressure) and safely set casing in the transition zone to maximize wellbore strength.

To avoid or reduce undesirable consequences, it would be advantageous if resistivity measurements from one or more offset wells could be used to determine a casing point or points in a wellbore being drilled before the bit exposes the formation during drilling the wellbore. The methods and apparatus of the present disclosure are directed to these needs.

SUMMARY

In accordance with the present disclosure, it has now been determined that a casing point in a wellbore being drilled may be identified, while the drill bit advances in the wellbore being drilled toward but does not penetrate the formation, using formation resistivity markers obtained from resistivity measurements obtained while drilling one or more subterranean offset wells. Optionally, in addition to resistivity measurements obtained from the one or more offset wells, resistivity in front of the bit measurements in the wellbore being drilled may be used to identify casing points in the wellbore. The wellbore being drilled may be for any purpose, including, but not limited to, hydrocarbon production, to inject fluid to maintain pressure in a reservoir, to dispose of unwanted produced water, to dispose of plant waste, to dispose of well cuttings, to produce carbon dioxide for use in enhanced recovery elsewhere, and to dispose of $CO_2$. To avoid unnecessary repetition, the terms "uncased interval of a wellbore" and "uncased interval of a well" will be used to indicate portions of wells being drilled for one or more of these end uses.

A first aspect of the disclosure is a method of determining a casing point or points in an uncased interval of a well during drilling of the well using a drilling mud, the method comprising:

a) drilling an uncased interval of the well with the mud using a drill bit and drill string at known dip and azimuth angles toward a region of interest in a known subterranean formation without the bit entering the region; and b) using formation resistivity markers obtained from resistivity measurements obtained while drilling one or more subterranean offset wells to identify one or more casing points in the uncased interval of the well while the drill bit advances toward but does not penetrate the region of interest while drilling the uncased interval of the well.

The resistivity markers in offset wells may be obtained prior to, or simultaneously with, the drilling of the uncased interval of the well. In methods where the resistivity markers are obtained simultaneously with drilling the uncased interval, the offset well or wells are drilled simultaneously with the uncased interval of the well. Certain methods further comprise casing the uncased interval based on the identified casing point or points.

Methods in accordance with this aspect include those methods wherein resistivity in front of the drill bit in the uncased interval of the well is used in conjunction with the resistivity markers from the offset well or wells to determine a casing point in the uncased interval of the well. For example, resistivity in front of the drill bit in the uncased interval of the well may be compared to the resistivity markers obtained during drilling of one or more offset wells.

A second aspect of the disclosure is a method of using resistivity measurements obtained while drilling one or more offset wells while drilling an uncased interval of a well using a drilling mud, the method comprising:

a) drilling one or more offset wells;

b) obtaining formation resistivity markers from resistivity measurements obtained while drilling at least one of the offset wells;

c) drilling an uncased interval of a well with a drilling mud using a drill bit and drill string at known dip and azimuth angles toward a region of interest in the formation without the bit entering the region of interest; and d) using the formation resistivity markers obtained from step (b) to identify one or more casing points in the uncased interval of the well while the drill bit advances toward but does not penetrate the formation while drilling the uncased interval of the well.

In certain embodiments the resistivity measurements obtained in the offset wells are generated from conventional resistivity measurements made from wireline or LWD tools. In other embodiments, the resistivity measurements obtained in the offset wells are generated from resistivity measurements ahead of the bit. Methods in accordance with this disclosure may measure resistivity in front of the bit using a method, for example, but not limited to: contact resistivity measurement focused in front to the bit; use of a transient electromagnetic survey; continuous deep directional electromagnetic measurements; and use of guided electromagnetic waves along the drill pipe. As explained further herein, each of these techniques would be modified to determine formation resistivity ahead of the bit during drilling, and prior to the bit penetrating the formation.

Certain embodiments further comprise adjusting the density, specific gravity, weight, viscosity, water content, oil content, composition, pH, flow rate, solids content, solids particle size distribution, resistivity, conductivity, or any combination of any of these, of the drilling mud based on resistivity markers in an offset well.

These and other features of the methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1:
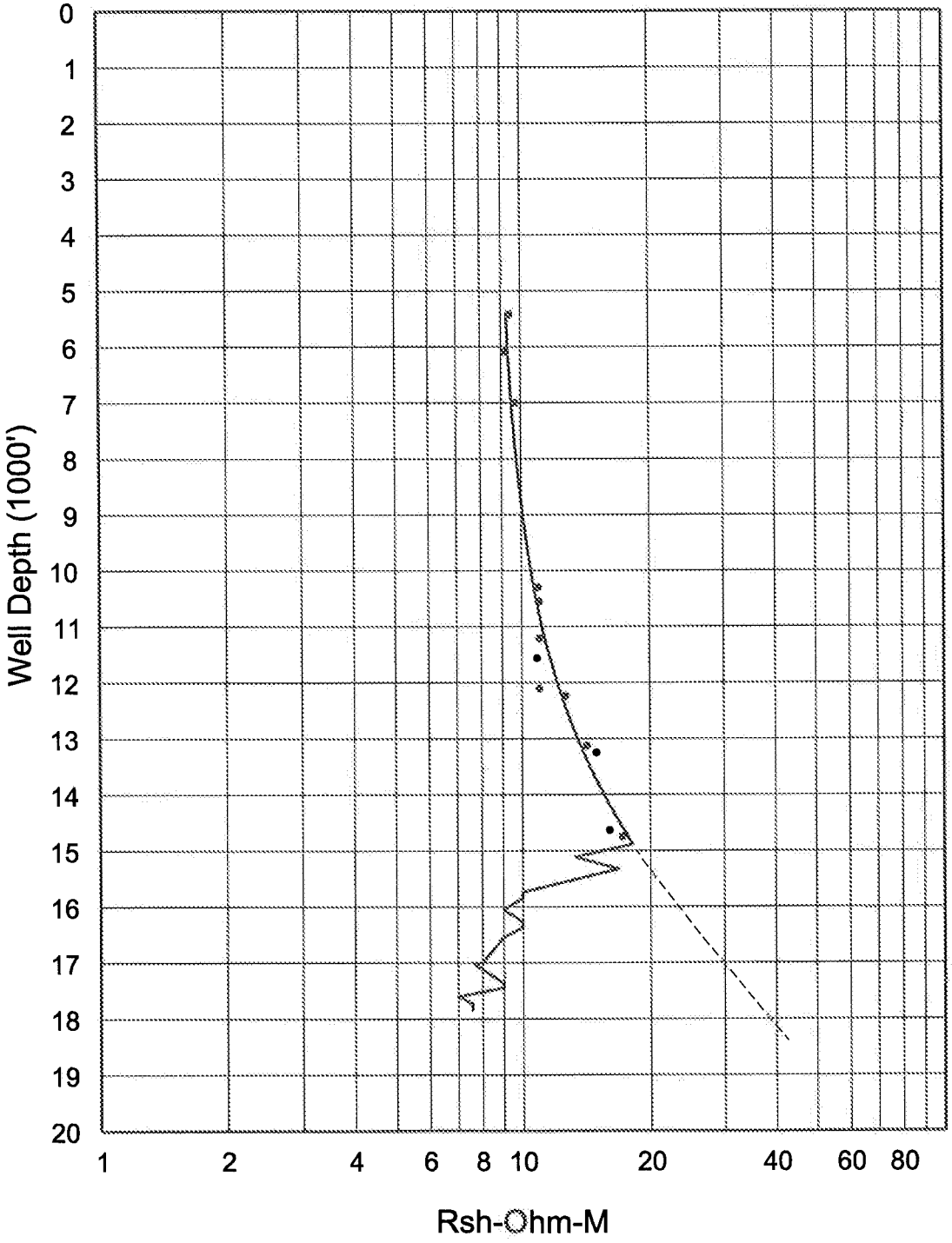
FIG. 1 illustrates graphically the prior art concept of measuring resistivity as a function of depth, showing a typical decrease in resistivity at a depth where increased geopressure (pore pressure) exists.

It is to be noted, however, that the appended drawings are not to scale and illustrate only typical embodiments of this disclosure, and are therefore not to be considered limiting of its scope, for the invention may admit to other equally effective embodiments. Identical reference numerals are used throughout the several views for like or similar elements.

DETAILED DESCRIPTION

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

As noted above, it has now been determined that a casing point in an uncased interval of a well being drilled may be identified using formation resistivity markers obtained from resistivity measurements obtained while drilling one or more offset wells obtained while the drill bit advances in the offset well toward but does not penetrate the formation. Optionally, in addition to resistivity measurements obtained from the one or more offset wells, resistivity in front of the bit measurements in an uncased interval of the well may be used to identify casing points in the uncased interval. Methods and apparatus of the invention are applicable to both on-shore (land-based) and offshore (subsea-based) drilling.

Figure 2A:
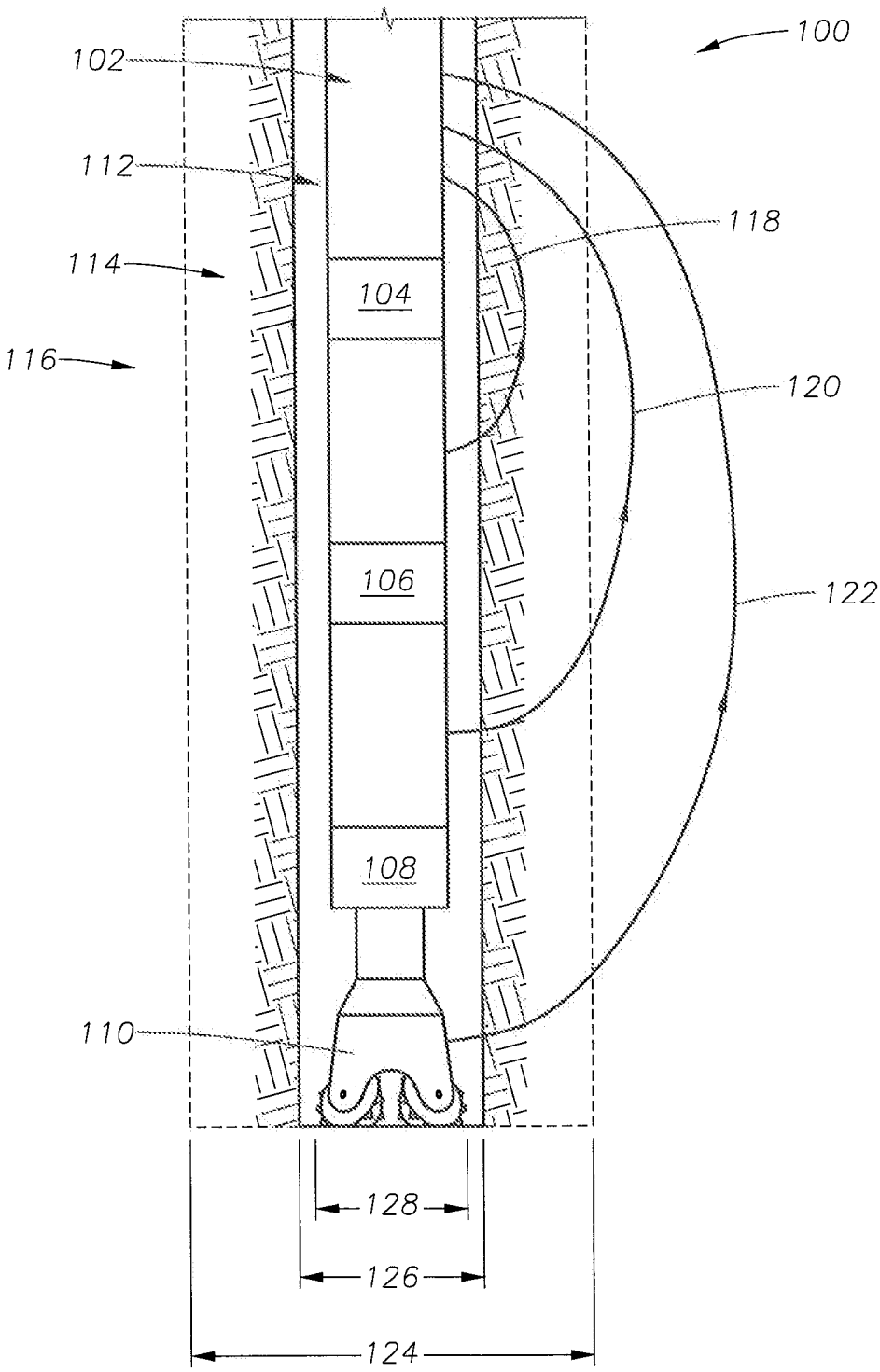
Fig. 2A (Prior Art)
FIG. 2A illustrates schematically a prior art method and apparatus for measuring resistivity.
Figure 2B:
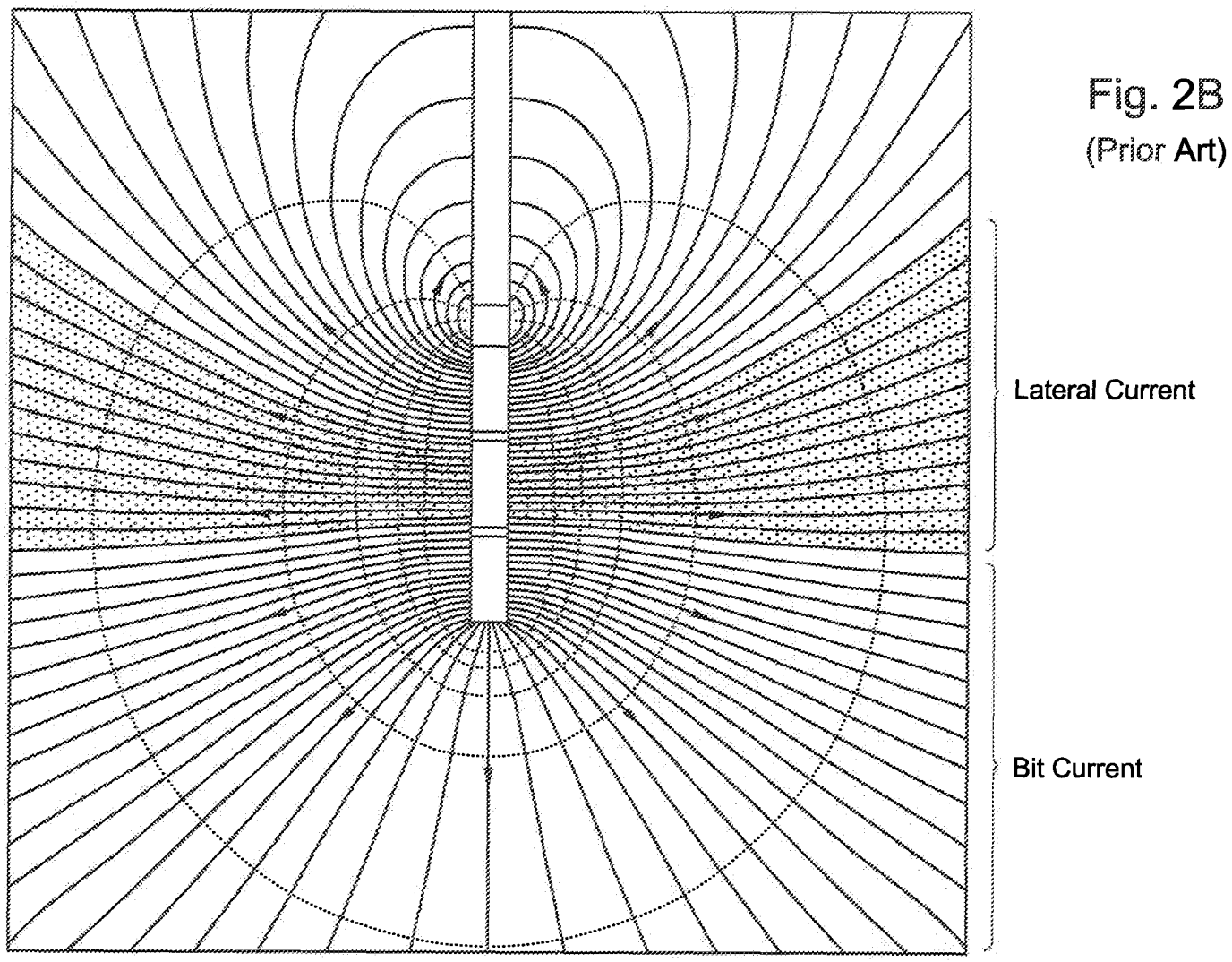
Fig. 2B (Prior Art)
FIG. 2B illustrates the computed current pattern obtained from the apparatus of FIG. 2A.

Conventional resistivity measurements obtained by wireline and LWD methods and apparatus are well-known and any one or more of them may be used to gather resistivity measurements in the offset well or wells. Any one of a number of methods may be used to log resistivity in front of the drilling bit, whether in the offset well(s), or uncased intervals of the well(s) being drilled, but the techniques are not generally known. The following discussion presents some non-limiting examples of how resistivity in front of the bit measurements may be obtained. It should be noted that resistivity may be measured in the offset well(s) using one method and apparatus, and the same or different method and apparatus in uncased intervals of the well(s). In one technique, a contact resistivity measurement focused in front of the bit may be employed. The contact resistivity measurement may be a modified version of that published by Gianzero et al., in their 1985 SPWLA paper (Paper A) "A New Resistivity Tool for Measurement-While-Drilling". In this implementation the drill string is electrically excited, and the current jumping off of the string is measured using toroids. FIG. 2A illustrates the Gianzero et al., apparatus 100, having a drill string collar 102, transmitter toroid 104, upper receiver toroid 106, and lower receiver toroid 108, and a drill bit 110. Illustrated also are the uncased interval of a wellbore 112, invaded zone 114, and virgin zone 116. A focusing current 118, lateral survey current 120, and bit survey current 122 are illustrated, as are the invasion diameter 124, borehole diameter 126, and bit diameter 128. In this implementation two measurements are made, one between the two toroids 106, 108 placed behind the bit, and the other between the lower toroid 108 and the bit 110, as depicted schematically in FIG. 2B. This lower measurement has a component of "forward looking" (downward in FIG. 2B, but this is not necessarily the direction of drilling) resistivity, but it is fractional due to the placement of the toroid 108 well behind the bit 110.

Figure 3A:
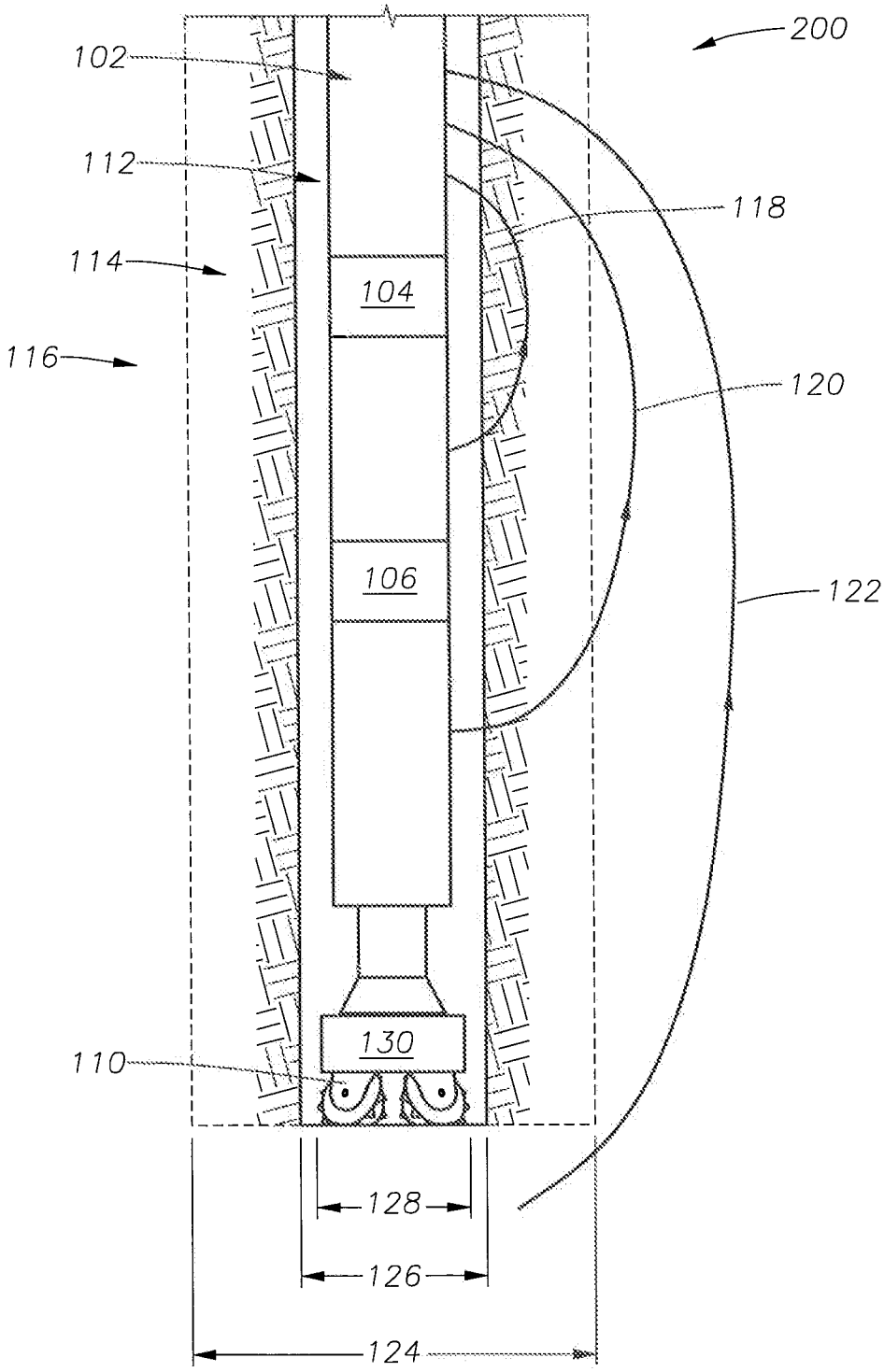
FIG. 3A illustrates schematically a method and apparatus of this disclosure for measuring resistivity in front of the drill bit.
Figure 3B:
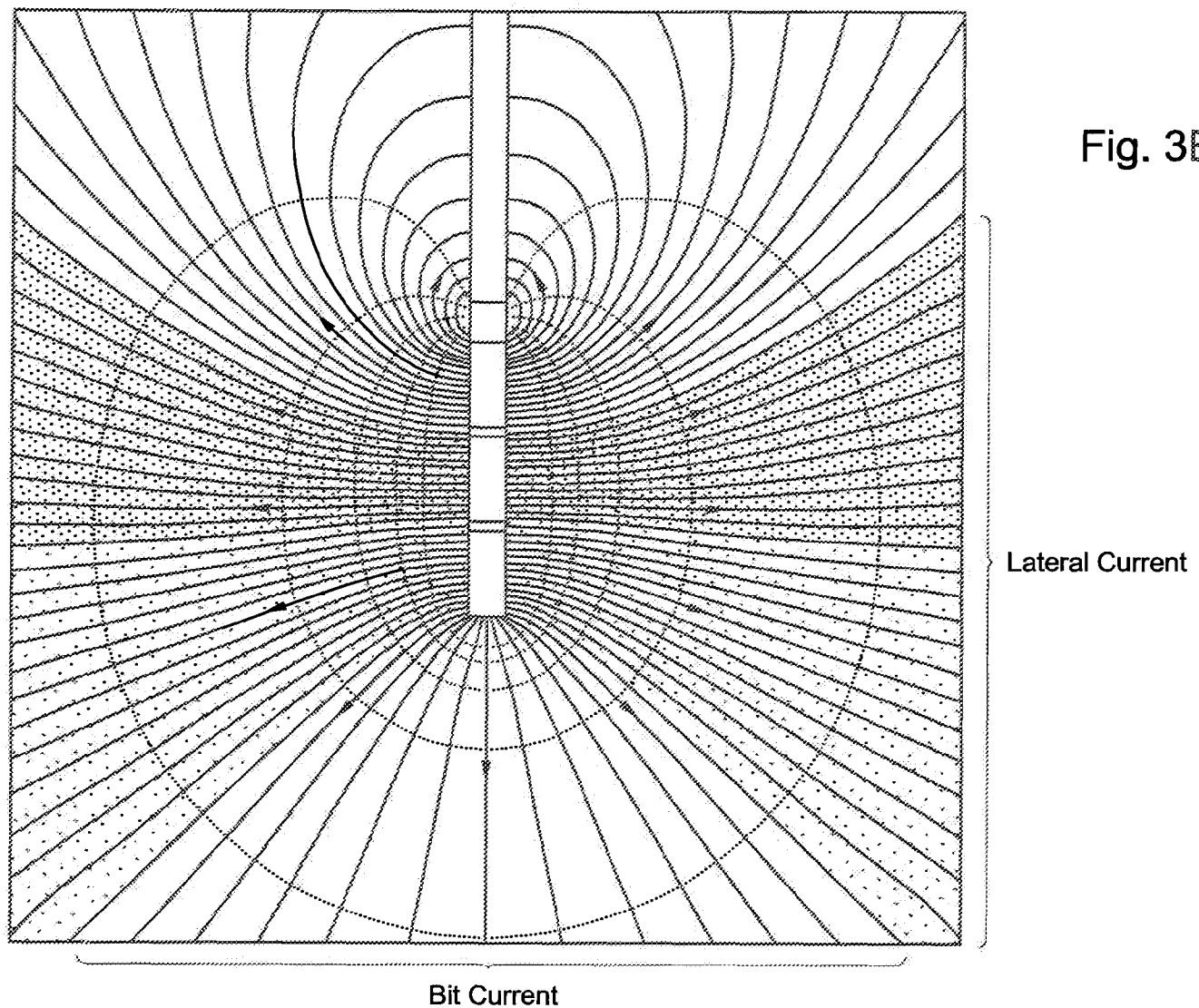
FIG. 3B illustrates the computed current pattern obtained from the apparatus of FIG. 3A.
Figure 3C:
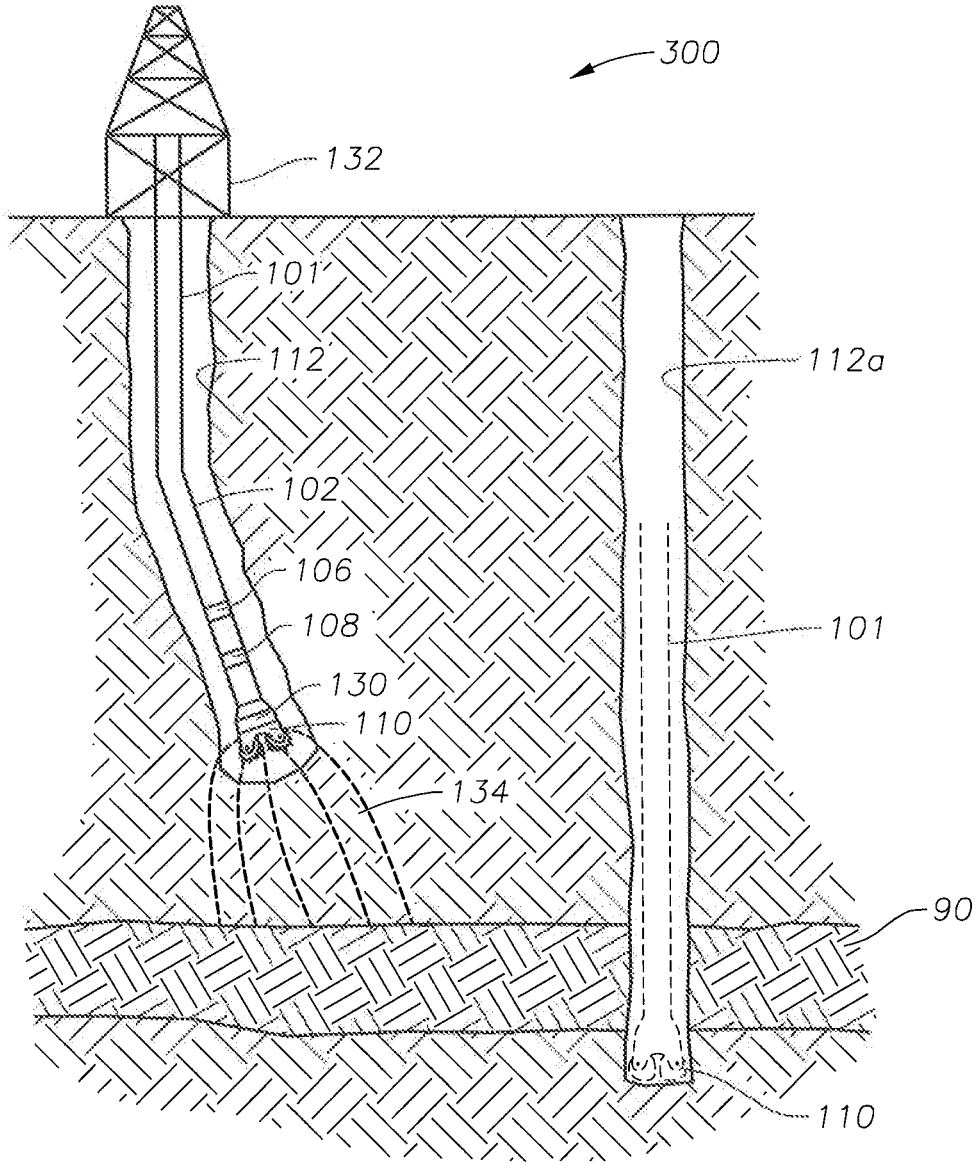
FIG. 3C illustrates a method in accordance with this disclosure, some components in phantom.

In accordance with the present disclosure, as illustrated in FIG. 3A, the lower toroid 130 is placed down at the tip of the bit 110, or very near thereto. In such embodiments the rock being investigated will be increasingly moved forward ahead of the bit 110, as illustrated schematically in FIG. 3B. While this may seem to be a subtle change, the result is much greater ability to focus the resistivity measurements in front of the drill, and allow one or more casing points to be identified in one or more uncased intervals of the wellbore prior to the bit entering the region that appears in need of casing. FIG. 3C illustrates a method in accordance with this disclosure, illustrating schematically in embodiment 300 including an offset well 112*a* from which resistivity data has been previously gathered using conventional methods from a region of interest 90 in the formation previously drilled using drillstring 101 and drill bit 110 (both illustrated in phantom in FIG. 3C). An uncased interval of the well 112 is illustrated being drilled using a drillrig 132, drill string 101, and drill bit 110. Well 112 is depicted as a deviated well, but this is not a necessary feature of the disclosure. Also depicted schematically are toroids 106, 108, and 130. Only the electric current ahead of the bit 134 is depicted. In certain embodiments, resistivity data gathered from the offset well 112*a* is used to guide the drilling of the uncased interval of well 112; in other instances it may be beneficial to measure in real time resistivity ahead of the bit while drilling the uncased interval of well 112, and compare the real time resistivity from the uncased interval of well 112 with resistivity gathered while drilling offset well 112*a*. Of course, other data, geomechanical models, and empirical data may also be used in conjunction with the resistivity data.

In another method, resistivity ahead of the drill bit may be made through use of a transient electromagnetic survey. The transient electromagnetic survey method is a relatively new technology that is currently being developed to measure formation resistivity below the earth's surface using a seabed device. Representative non-patent literature references include SPE 11054, SPE 108631, and IPTC 11511. U.S. Pat. Nos. 7,203,599; 7,202,669; 7,023,213; and 7,307,424, all incorporated herein by reference in their entirety, may be mentioned as further examples. The '599 patent discloses a method for controlled source electromagnetic (CSEM) Earth surveying, including deploying a plurality of electromagnetic sensors in a selected pattern at the top of an area of the Earth's subsurface to be surveyed. At least one of a transient electric field and a transient magnetic field is applied to the Earth in the vicinity of the sensors at a plurality of different positions. At least one of electric field amplitude and magnetic field amplitude at each of the sensors is recorded each time the transient electric field and/or magnetic field is applied. Each recording is adjusted for acquisition geometry. An image is generated corresponding to at least one sensor position using at least two stacked, adjusted recordings. The '669 patent discloses applying an electromagnetic field using a dipole antenna transmitter, and detecting using a dipole antenna receiver. The measurements are taken with the antenna both in-line and parallel and the difference between the two sets of measurements exploited. A characteristic difference indicates a high resistive layer, which corresponds to a hydrocarbon reservoir. The '213 patent discloses a subsurface imaging cable, including a plurality of sensor modules, wherein the plurality of the sensor modules are flexible and each of the plurality of the sensor modules is spaced apart on the subsurface imaging cable at a selected distance; and a flexible medium connecting the plurality of the sensor modules, wherein the subsurface imaging cable is flexible and adapted to be wound on a reel. A method for subsurface images includes acquiring direct-current measurements at a plurality of sites in a survey area; acquiring a first set of electric and magnetic measurements from natural electromagnetic fields at the plurality of sites; acquiring a second set of electric and magnetic measurements using controlled electric and magnetic sources at the plurality of sites; and determining a subsurface conductivity distribution from the direct-current measurements and the first set and the second set of electric and magnetic measurements. The '424 patent discloses an electromagnetic survey method for surveying an area that potentially contains a subterranean hydrocarbon reservoir. The method comprises detecting a detector signal in response to a source electromagnetic signal, resolving the detector signal along at least two orthogonal directions, and comparing phase measurements of the detector signal resolved along these directions to look for a phase separation anomaly indicative of the presence of a buried hydrocarbon layer. The '424 patent also discloses planning a survey using this method, and analysis of survey data taken using this survey method. The first and second data sets may be obtained concurrently with a single horizontal electric dipole source antenna. The method is also largely independent of a source-detector pair's relative orientation and so provides for good spatial coverage and easy-to-perform surveying.

Figure 4:
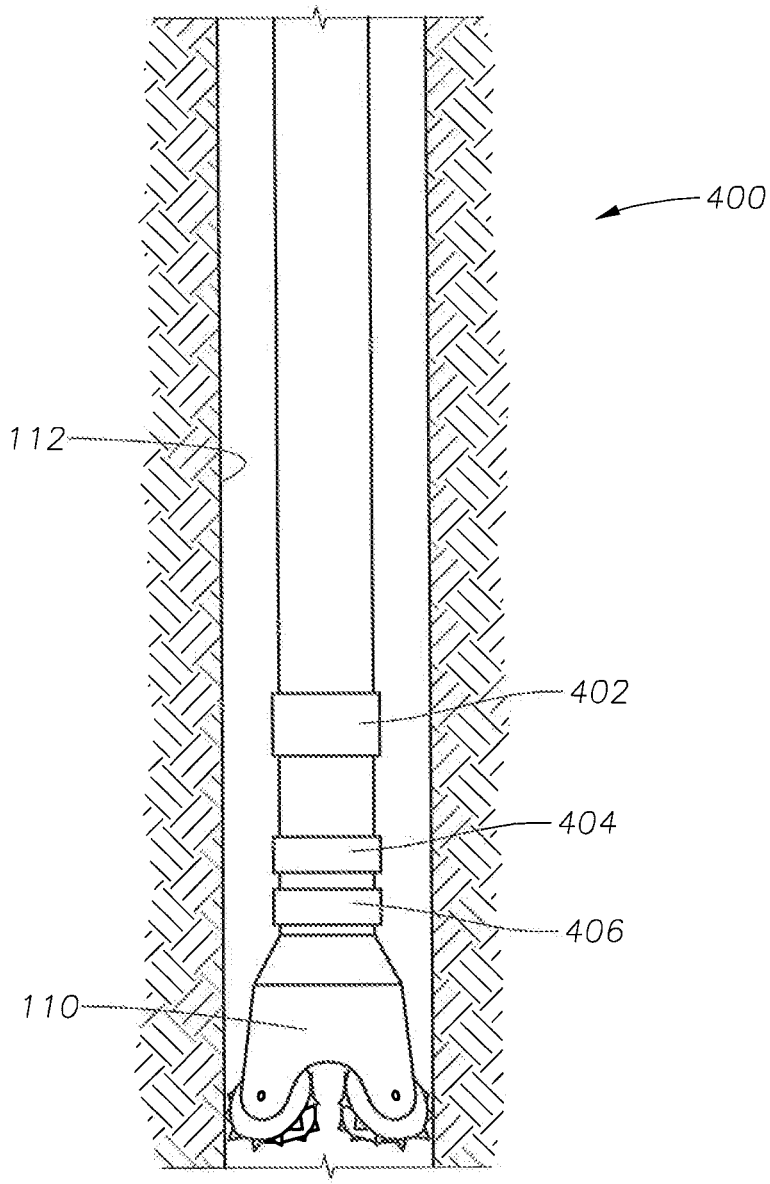
FIG. 4 illustrates schematically a transient electromagnetic survey apparatus deployed within a borehole to measure resistivity in front of the drill bit.

In accordance with the present disclosure, transient electromagnetic survey techniques and apparatus normally used in marine surveys may be modified to be deployed within a well 112, as illustrated schematically in embodiment 400 of FIG. 4. A dipole transmitter 402 is mounted on the drill string behind the drill bit 110, and EM receivers 404 and 406 are mounted below the dipole. The EM receivers 404, 406 measure a normally reflected wave in the axis of the drill string. This normally reflected wave would be off of resistivity contrasts directly in front of the bit. This would work very much like an acoustic VSP but working in the electromagnetic spectrum. It should be understood that embodiment 400 could also be illustrated as embodiment 300 in FIG. 3C, that is, resistivity in front of the drill bit in an uncased interval of a well being drilled could be measured and compared to resistivity measured in one or more offset wells (where resistivity in the offset wells is measured conventionally or using one of the techniques described herein for measuring resistivity in front of the bit).

Figure 5:
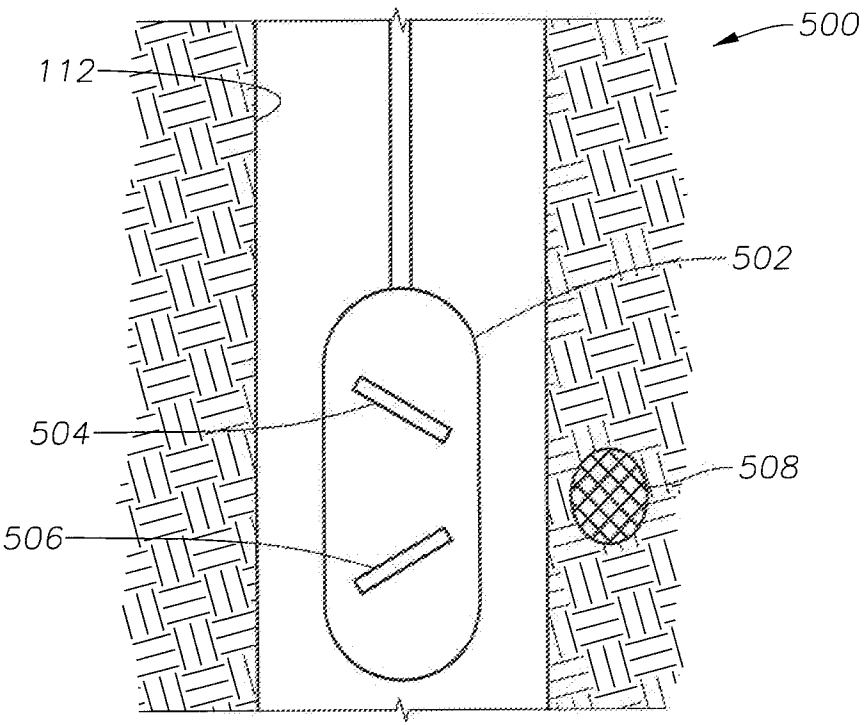
Fig. 5 (Prior Art)
FIG. 5 is a schematic illustration representative of the prior art technique and apparatus of Sato et al., illustrating a method of and an apparatus for directional induction logging of formations around a borehole.

Another method to make a resistivity measurement in front of the bit would be to use modified continuous deep directional electromagnetic measurements. Deep directional electromagnetic (EM) tool measurements are known and explained, for example, in Omeragic et al., "Deep Directional Electromagnetic Measurements for Optimal Well Placement", SPE 97045 (2005), and Sato et. al., U.S. Pat. No. 5,508,616, incorporated by reference herein. Illustrated in FIG. 5 is a representative example embodiment 500 of the prior art technique and apparatus of Sato et al., illustrating a method of and an apparatus for directional induction logging of formations around a borehole. The aim was to measure the electric conductivity of a formation in a particular direction with respect to the circumference of the borehole. In the method and apparatus according to Sato et al., at least one transmitting coil 506 and at least one receiving coil 504 are disposed in an uncased interval of a wellbore 112 and along the axis thereof in an inclined fashion such that these coils face one another and thus are caused to have directivity provided for examining electric characteristics of a formation around the borehole. The transmitting and receiving coils 506 and 504 are disposed such that the axes of these coils are inclined by an inclination angle while these coils face each other. With this arrangement, directivity can be obtained. Further, the transmitting and receiving coils 506 and 504 are rotated in the uncased interval of wellbore 112 by a drive device (not illustrated) for measuring the electric conductivity around the borehole. Further, the electric conductivity is measured continuously along the hole axis by rotating the transmitting and receiving coils in the borehole by the drive device. An alternating current is supplied to the transmitting coil 506 from a transmitter to generate a magnetic field, thus generating an eddy current substantially proportional to the electric conductivity in the surrounding formation. The eddy current generates a secondary magnetic field which is measured with the receiving coil 504. The amplitude of the voltage induced across the receiving coil 504 and the phase difference with respect to the current supplied to the transmitting coil 506 are measured (for example by a phase sensitive detector to be transmitted via a cable to the ground surface for recording with well-known recording means). With the inclination of the transmitting and receiving coils in one direction, there is formed a place 508 in the surrounding formation of concentration of eddy current generation, and thus it is possible to measure only the electric conductivity in a particular direction. This technique may be used in methods of the present disclosure to measure resistivity in offset wells.

Figure 6:
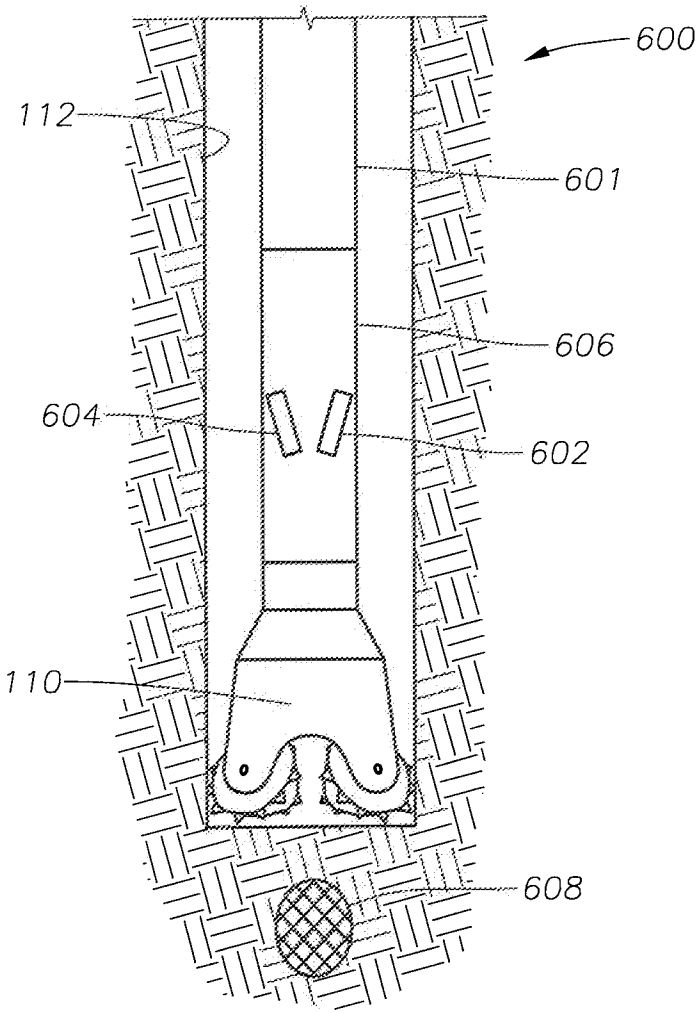
FIG. 6 illustrates schematically a modified apparatus of FIG. 5, modified for the purposes of the present disclosure to have the receivers tuned to isolate the signal arriving from the formation in front of the drill bit.

The methods and apparatus of Sato et al. exemplified by prior art embodiment 500 in FIG. 5 may be modified for the purposes of the present disclosure to have the receivers tuned to isolate the signal arriving from the formation in front of the bit, as illustrated schematically in embodiment 600 of FIG. 6 in an offset well 112*a*. Embodiment 600 includes a tool 606 including a transmitter and receiver pair, 602, 604 in the drill string 601. With the inclination of the transmitting and receiving coils as illustrated in FIG. 6, there is formed a place 608 in front of the drill bit 110 for concentration of eddy current generation, and thus it is possible to measure the electrical conductivity in front of the drill bit during drilling of a well, prior to the bit entering the region of interest in the formation. The region 608 might be, for example, 1 to 100 feet in front of the drill bit, or 1 to 90, or 1 to 80, or 1 to 70, or 1 to 60, or 1 to 50, or 1 to 40, or 1 to 30, or 1 to 20 feet in front of the drill bit. The distance resistivity can be measured in front of the bit is, in part, a function of the conductivity contrast between the conductivity of the formation in which the tool is located and the conductivity of the formations in front of the bit. In inductive measurements as described in Sato et al. the distance one can see ahead increases as the conductivity of the formation ahead of the bit increases relative to the conductivity of the formation in which the tool is located. In resistivity measurements as described in Gianzero et al. the distance one can see ahead increases as the conductivity of the formation ahead of the bit decreases relative to the conductivity of the formation in which the tool is located. The distance a tool can measure ahead can also be a function of the sensitivity of the electronics, especially in the case of a transient electromagnetic method.

Figure 7:
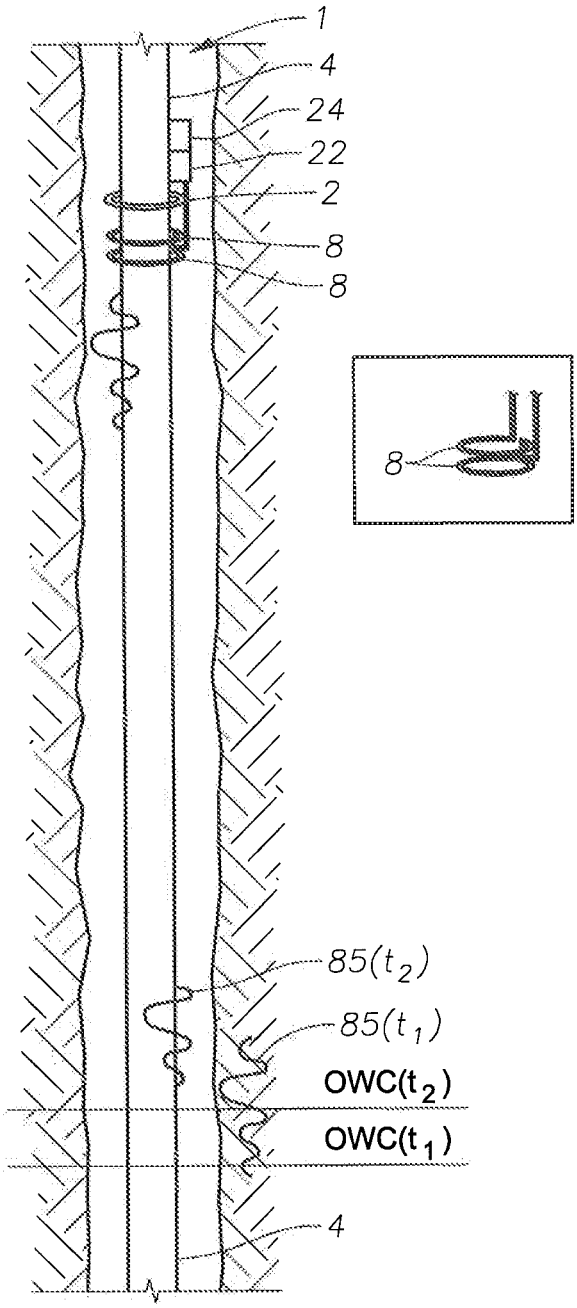
Fig. 7 (Prior Art)
FIG. 7 illustrates schematically a prior art apparatus for detecting changes of resistivity or dielectrical properties due to changes of fluid composition in the near-well area about a well in a geological formation.

Another method would be to use guided electromagnetic waves along the drill pipe to focus energy in front of the bit and measure the formation resistivity in this manner. This would be similar to that described in U.S. Pat. No. 6,556,014, incorporated by reference herein, except that it would be optimized to maximize the signal from the formation in front of the bit. In the '014 patent, a device is disclosed as illustrated herein in FIG. 7, for detecting changes of resistivity or dielectrical properties due to changes of fluid composition in the near-well area about a well 1 in a geological formation, comprising an electrically conductive tubing string 4, an electrical energy source 24, a signal generator 22, at least one transmitting antenna 2 for emitting electromagnetic waves along tubing string 4, one or more receiver antennas 8 for receiving electromagnetic waves 85 reflected from oil/water contact (OWC) along tubing string 4, devices for receiving signals 85 induced in receiver antennas 8, signal processing means (not illustrated) for processing the received signals 85, and communication devices (not illustrated) for transmitting signals representing the electrical signals and for receiving control signals.

Figure 8:
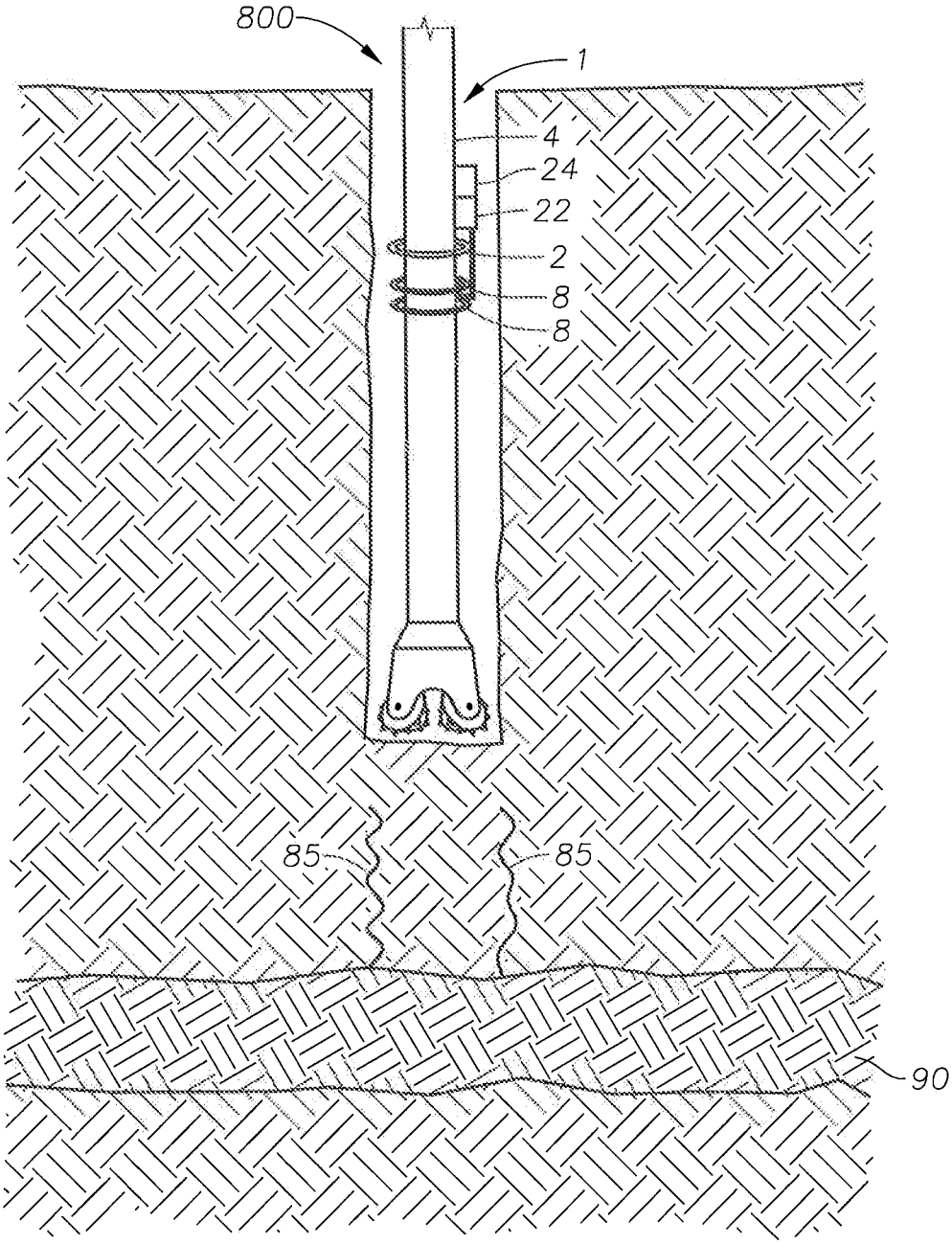
FIG. 8 illustrates schematically an apparatus in accordance with the present disclosure modified to focus energy in front of the drill bit and measure the formation resistivity ahead of the drill bit.

FIG. 8 illustrates an embodiment 800 modified to focus energy in front of the bit and measure the formation resistivity ahead of the drill bit. Rather than sensing an oil/water contact, the reflected waves 85 would be reflected off of the top of a region of interest 90, containing perhaps, but not necessarily, hydrocarbons.

In accordance with the present disclosure, a primary interest lies in using resistivity measurements gathered by one or more conventional wireline or LWD methods, or one of the methods and apparatus described above to obtain resistivity measurements in front of the drill bit while drilling one or more offset wells, to identify casing points in an uncased interval of a well being drilled but prior to the bit entering the formation. The skilled operator or well designer will determine which resistivity method and apparatus is best suited for a particular offset well and formation to achieve the highest efficiency without undue experimentation.

The identity of casing points in an uncased interval of a well being drilled using formation resistivity markers obtained from resistivity measurements obtained while drilling one or more offset wells may be made on resistivity measurements alone, or the resistivity measurements may be used to calculate pore pressure, and this used in identifying casing points. The calculation of pore pressure from resistivity is straightforward, one method being that described by Hottman et al. In this calculation method, first the normal compaction trend for the area of interest is established by plotting the logarithm of shale resistivity from the device vs. depth. A similar plot is made for the well in question. The pressure gradient of a reservoir at any depth is found by calculating the ratio of the extrapolated normal shale resistivity, and the fluid pressure gradient corresponding to the calculated ratio. The reservoir pressure is obtained by multiplying the fluid pressure gradient value by the depth. A pressure gradient profile ahead of the bit for the well can be constructed by repeating the procedure using the resistivity measured ahead of the bit. A casing point can be identified once the pressure calculated ahead of the bit exceeds the strength of the weakest exposed formations in the well and accounting for normal safety margins.

Another commonly used method to calculate pore pressure from resistivity is through the use of the Eaton relationship (Eaton, B. A., 1975, "The Equation for Geopressure Prediction from Well LOGS": SPE paper #5544). In this calculation method, first the normal compaction trend for the area of interest is established by plotting the logarithm of shale resistivity from the device vs. depth. A similar plot is made for the well in question. The pressure gradient of a reservoir at any depth is found by calculating the ratio of the measured shale resistivity to the extrapolated normal shale resistivity. The reservoir pressure is obtained by raising the ratio to the Eaton exponent (normally 1.2 for resistivity measurements) and then multiplying that against the difference between overburden stress minus normal pressure and then subtracting that from the overburden pressure. A pressure gradient profile ahead of the bit for the well can be constructed by repeating the procedure using the resistivity measured ahead of the bit. A casing point can be identified once the pressure calculated ahead of the bit exceeds the strength of the weakest exposed formations in the well and accounting for normal safety margins.

Useful drilling muds for use in the methods of the present disclosure include water-based, oil-based, and synthetic-based muds. The same or different muds may be used in drilling the offset well(s) and uncased intervals of the well(s.) The choice of formulation used is dictated in part by the nature of the formation in which drilling is to take place. For example, in various types of shale formations, the use of conventional water-based muds can result in a deterioration and collapse of the formation. The use of an oil-based formulation may circumvent this problem. A list of useful muds would include, but not be limited to, conventional muds, gas-cut muds (such as air-cut muds), balanced-activity oil muds, buffered muds, calcium muds, deflocculated muds, diesel-oil muds, emulsion muds (including oil emulsion muds), gyp muds, oil-invert emulsion oil muds, inhibitive muds, kill-weight muds, lime muds, low-colloid oil muds, low solids muds, magnetic muds, milk emulsion muds, native solids muds, PHPA (partially-hydrolyzed polyacrylamide) muds, potassium muds, red muds, saltwater (including seawater) muds, silicate muds, spud muds, thermally-activated muds, unweighted muds, weighted muds, water muds, and combinations of these.

Useful mud additives include, but are not limited to asphaltic mud additives, viscosity modifiers, emulsifying agents (for example, but not limited to, alkaline soaps of fatty acids), wetting agents (for example, but not limited to dodecylbenzene sulfonate), water (generally a NaCl or $CaCl_2$ brine), barite, barium sulfate, or other weighting agents, and normally amine treated clays (employed as a viscosification agent). More recently, neutralized sulfonated ionomers have been found to be particularly useful as viscosification agents in oil-based drilling muds. See, for example, U.S. Pat. Nos. 4,442,011 and 4,447,338, both incorporated herein by reference. These neutralized sulfonated ionomers are prepared by sulfonating an unsaturated polymer such as butyl rubber, EPDM terpolymer, partially hydrogenated polyisoprenes and polybutadienes. The sulfonated polymer is then neutralized with a base and thereafter steam stripped to remove the free carboxylic acid formed and to provide a neutralized sulfonated polymer crumb. To incorporate the polymer crumb in an oil-based drilling mud, the crumb must be milled, typically with a small amount of clay as a grinding aid, to get it in a form that is combinable with the oil and to keep it as a noncaking friable powder. Often, the milled crumb is blended with lime to reduce the possibility of gelling when used in the oil. Subsequently, the ionomer containing powder is dissolved in the oil used in the drilling mud composition. To aid the dissolving process, viscosification agents selected from sulfonated and neutralized sulfonated ionomers can be readily incorporated into oil-based drilling muds in the form of an oil soluble concentrate containing the polymer as described in U.S. Pat. No. 5,906,966, incorporated herein by reference. In one embodiment, an additive concentrate for oil-based drilling muds comprises a drilling oil, especially a low toxicity oil, and from about 5 gm to about 20 gm of sulfonated or neutralized sulfonated polymer per 100 gm of oil. Oil solutions obtained from the sulfonated and neutralized sulfonated polymers used as viscosification agents are readily incorporated into drilling mud formulations.

The mud system used in drilling the offset and uncased intervals of wells may be open or closed systems. Any system used should allow for samples of circulating mud to be taken periodically, whether from a mud flow line, a mud return line, mud motor intake or discharge, mud house, mud pit, mud hopper, or two or more of these, as dictated by the resistivity data being received.

In actual operation, depending on the mud report from the mud engineer, the drilling rig operator (or owner of the well) has the opportunity to adjust the density, specific gravity, weight, viscosity, water content, oil content, composition, pH, flow rate, solids content, solids particle size distribution, resistivity, conductivity, and combinations of these properties of the mud in the uncased intervals being drilled. The mud report may be in paper format, or more likely today, electronic in format. The change in one or more of the list parameters and properties may be tracked, trended, and changed by a human operator (open-loop system) or by an automated system of sensors, controllers, analyzers, pumps, mixers, agitators (closed-loop systems).

"Drilling" as used herein may include, but is not limited to, rotational drilling, directional drilling, non-directional (straight or linear) drilling, deviated drilling, geosteering, horizontal drilling, and the like. The drilling method may be the same or different for the offset and uncased intervals of the wells. Rotational drilling may involve rotation of the entire drill string, or local rotation downhole using a drilling mud motor, where by pumping mud through the mud motor, the bit turns while the drillstring does not rotate or turns at a reduced rate, allowing the bit to drill in the direction it points. A turbodrill may be one tool used in the latter scenario. A turbodrill is a downhole assembly of bit and motor in which the bit alone is rotated by means of fluid turbine which is activated by the drilling mud. The mud turbine is usually placed just above the bit.

"Bit" or "drill bit", as used herein, includes, but is not limited to antiwhirl bits, bicenter bits, diamond bits, drag bits, fixed-cutter bits, polycrystalline diamond compact bits, roller-cone bits, and the like. The choice of bit, like the choice of drilling mud, is dictated in part by the nature of the formation in which drilling is to take place. The drill bit may be the same or different for the offset and uncased intervals of the wells. There are at least five basic types of core bits used based on their function or structure: drag, scraper, abrasive, roller cone, and hammer. Drag-type bits have a flat chisel-like surface to plane away soft formations (i.e., clay and chalk). Polycrystalline diamond compact (PDC) bits use multiple tungsten carbide studs with artificial diamond cutting surfaces in a claw-like scraping action to remove soft formations (e.g., clay and chalk) up to hard claystone and limestone. Diamond bits use either surface-set or impregnated diamonds to abrade (i.e., sanding-like process) hard formations like shale or basalt. Roller cone bits rotate cone-shaped rollers encrusted with teeth to remove soft to hard formations through a combination of scraping and crushing processes. Hammer bits use percussion to crush the hard rock around the core. Smaller bits called "shoes" may be screwed onto the bottom of the inner core barrel. The shoes on the inner core barrel protrude below the primary roller cone bit and trim the formation to core size. In contrast, the primary core bits in the rotary core barrel (RCB) and advanced diamond core barrel (ADCB) systems cut away most of the formation to create the core (i.e., there is no shoe).

The rate of penetration (ROP) during drilling methods of this disclosure depends on permeability of the rock (the capacity of a porous rock formation to allow fluid to flow within the interconnecting pore network), the porosity of the rock (which is the volume of pore spaces between mineral grains expressed as a percentage of the total rock volume, and thus porosity is a measure of the capacity of the rock to hold oil, gas, or water), and the amount or percentage of vugs. Generally the operator or owner of the drilling well wishes the ROP to be as high as possible toward a known or potential trap (any geological structure which precludes the migration of oil and gas through subsurface rocks, causing the hydrocarbons to accumulate into pools), without excess tripping in and out of the wellbore. In accordance with the present disclosure the drilling contractor or operator is able to drill more confidently and safely, knowing the resistivity and pore pressure in the formation ahead of the drill bit before the drill bit actually penetrates the region where a casing point is to be identified.

Figure 9:
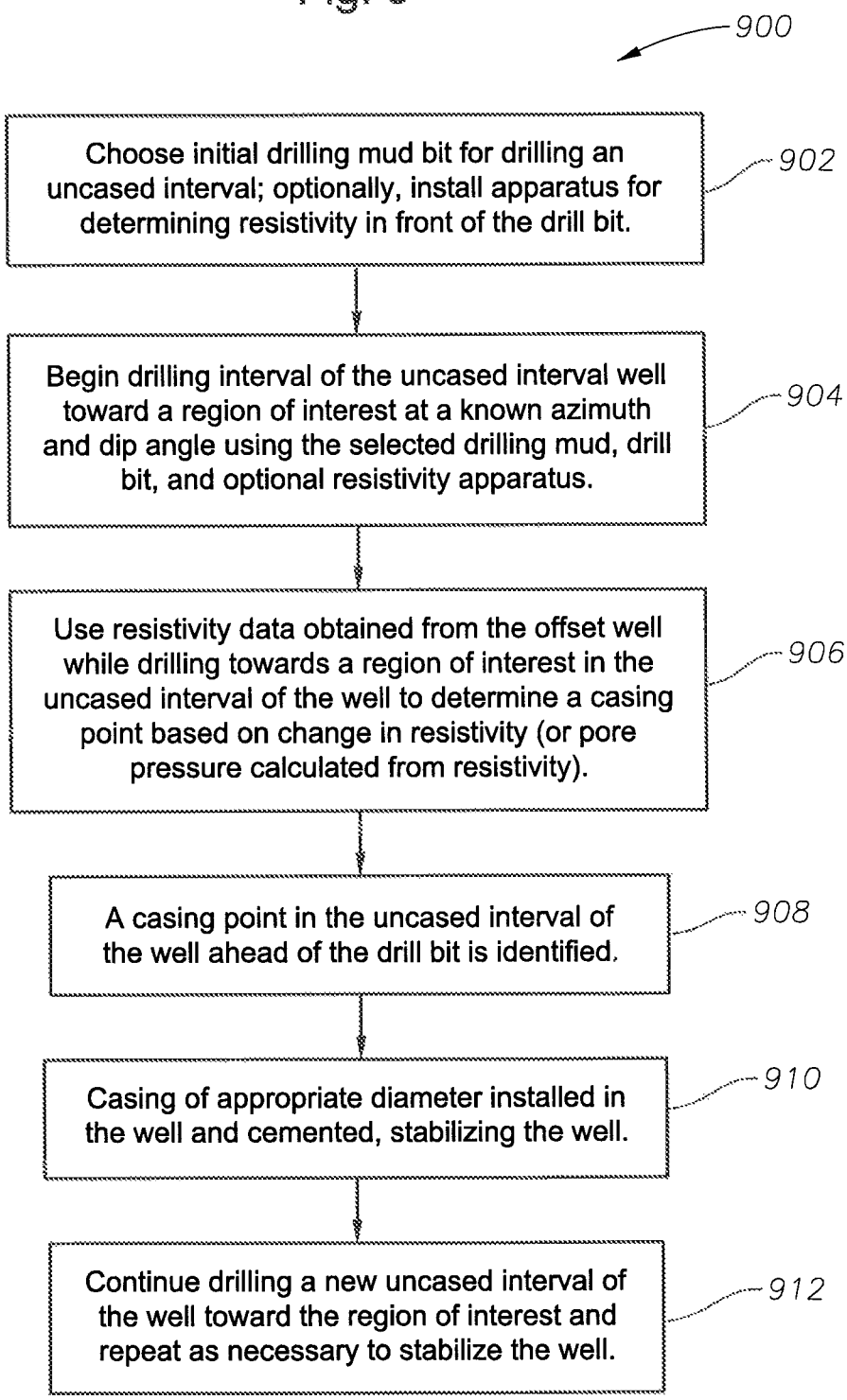
FIG. 9 illustrates one method of the present disclosure in flowchart form.

FIG. 9 illustrates one method embodiment 900 of the present disclosure in flowchart form. Assuming resistivity in front of the drill bit is already available from one or more offset wells, first, as indicated in box 902, the drilling supervisor, probably in conjunction with the mud engineer, geologist or other person in charge would choose initial drilling mud for drilling an uncased interval of the well, and the driller would choose the drill bit for drilling the uncased interval of the well. Optionally, apparatus for determining resistivity in front of the drill bit may be selected and installed in the drill string, either on-site or at a site removed from the well. In box 904, the drilling is then begun, drilling toward a region of interest at a known azimuth and dip angle using the selected drilling mud and drill bit (and selected resistivity apparatus, in some embodiments). Box 906, resistivity data in front of the offset bit is used while drilling toward the region of interest in the uncased interval of the well to determine a casing point based on change in resistivity (or pore pressure calculated from resistivity). Box 908, a casing point in the uncased interval of the well is identified. Box 910, casing of appropriate diameter installed in the well and cemented, stabilizing the well. Box 912, continue drilling toward the region of interest, and repeat as necessary to stabilize the well. The resistivity may be measured continuously in real time, semi-continuously, periodically, or intermittently as desired. Porosity may be calculated at the same or different rate as the measurement of resistivity.

From the foregoing detailed description of specific embodiments, it should be apparent that patentable methods and apparatus have been described. Although specific embodiments of the disclosure have been described herein in some detail, this has been done solely for the purposes of describing various features and aspects of the methods and apparatus, and is not intended to be limiting with respect to the scope of the methods and apparatus. It is contemplated that various substitutions, alterations, and/or modifications, including but not limited to those implementation variations which may have been suggested herein, may be made to the described embodiments without departing from the scope of the appended claims. For example, drill bit, core bit, drilling muds, and resistivity measurement apparatus other than those specifically described above may be employed, and are considered within the disclosure.

What is claimed is:

1. A method of determining a casing point in an uncased interval of a well being drilled using a drilling mud, the method comprising:

drilling a first uncased interval of the well with the drilling mud using a drill bit and drill string toward a region of interest in a subterranean formation without the drill bit entering the region of interest;

measuring, during drilling in the first uncased interval of the well, resistivity in front of the drill bit;

comparing the resistivity measured in front the of the drill bit to formation resistivity markers obtained during drilling of one or more offset well;

determining, based on the comparison of the resistivity measured in front the of the drill bit to the formation resistivity markers, one or more casing points in the first uncased interval of the well while the drill bit advances toward but does not penetrate the region of interest while drilling the well; and casing the first uncased interval of the well based on the one or more casing points.

2. The method of claim 1, the method further comprising gathering the resistivity markers in the one or more offset wells prior to or simultaneously with the drilling of the first uncased interval of the well.

3. The method of claim 2, wherein the resistivity markers are obtained simultaneously with drilling the first uncased interval of the well, and the one or more wells are being drilled simultaneously with the first uncased interval of the well.

4. The method of claim 1, wherein the drilling mud is selected from the group consisting of oil-based muds, water-based muds, and synthetic-based muds.

5. The method of claim 1, wherein the resistivity markers from the one or more offset wells are obtained prior to drilling the first uncased interval of the well.

6. The method of claim 1, the method further comprising adjusting a parameter selected from the group consisting of the density, specific gravity, weight, viscosity, water content, oil content, composition, pH, flow rate, solids content, solids particle size distribution, resistivity, conductivity, or any combination of any of these, of the drilling mud based on the resistivity markers from the one or more offset wells.

7. The method of claim 1, wherein measuring the resistivity comprises a method selected from the group consisting of contact resistivity measurement focused in front of the drill bit, use of a transient electromagnetic survey, continuous deep directional electromagnetic measurements, and use of guided electromagnetic waves along the drill string.

8. A method of using resistivity measurements obtained while drilling one or more subterranean offset wells in drilling a subterranean uncased interval of a well system, the method comprising:

drilling one or more offset wells;

obtaining formation resistivity markers from resistivity measurements obtained while drilling at least one of the one or more offset wells;

drilling a first uncased interval of a well with a drilling mud using a drill bit and drill string at known dip and azimuth angles toward a potential hydrocarbon producing region of interest in a formation without the drill bit entering the potential hydrocarbon producing region of interest;

measuring, during drilling in the first uncased interval of the well, resistivity in front of the drill bit;

comparing the resistivity measured in front the of the drill bit to the formation resistivity markers obtained during drilling of the one or more offset well;

determining, based on the comparison of the resistivity measured in front the of the drill bit to the formation resistivity markers, one or more casing points in the first uncased interval of the well while the drill bit advances toward but does not penetrate the formation while drilling the first uncased interval of the well; and casing the first uncased interval of the well based on the the one or more casing points.

9. The method of claim 8, wherein measuring the resistivity in front of the drill bit comprises a method selected from the group consisting of contact resistivity measurement focused in front of the drill bit, use of a transient electromagnetic survey, continuous deep directional electromagnetic measurements, and use of guided electromagnetic waves along the drill string.

10. The method of claim 8, the method further comprising adjusting a parameter selected from the group consisting of the density, specific gravity, weight, viscosity, water content, oil content, composition, pH, flow rate, solids content, solids particle size distribution, resistivity, conductivity, or any combination of any of these, of the drilling mud used in drilling the first uncased interval of the well based on the resistivity measurements of the one or more offset wells as the drill bit in the first uncased interval of the well approaches a depth equal to the depth of the offset wells when the resistivity measurements were taken in the one or more offset wells.

11. A system for drilling a well, the system comprising:

a drill string;

a drill bit, coupled to the drill string, for drilling a first uncased interval of the well with a drilling mud toward a region of interest in a formation without the drill bit entering the region of interest;

at least one sensor coupled to at least one of the drill sting and the drill bit, the at least one sensor configured to measure, during drilling in the first uncased interval of the well, resistivity in front of the drill bit; and a processing device coupled to the at least one sensor, the processing device being configured to:

determine formation resistivity markers from resistivity measurements obtained while drilling one or more offset wells;

compare the resistivity measured in front the of the drill bit to the formation resistivity markers obtained during drilling of the one or more offset well; and determine, based on the comparison of the resistivity measured in front the of the drill bit to the formation resistivity markers, one or more casing points in the first uncased interval of the well while the drill bit advances toward but does not penetrate the formation while drilling the first uncased interval of the well.

12. The system of claim 11, wherein measuring the resistivity in front of the drill comprises a method selected from the group consisting of contact resistivity measurement focused in front of the drill bit, use of a transient electromagnetic survey, continuous deep directional electromagnetic measurements, and use of guided electromagnetic waves along the drill string.

13. The system of claim 11, wherein the processing device is further configured to adjust a parameter selected from the group consisting of the density, specific gravity, weight, viscosity, water content, oil content, composition, pH, flow rate, solids content, solids particle size distribution, resistivity, conductivity, or any combination of any of these, of drilling mud used in drilling the first uncased interval of the well based on the resistivity measurements of the one or more offset wells as the drill bit in the first uncased interval of the well approaches a depth equal to the depth of the offset wells when the resistivity measurements were taken in the one or more offset wells.

* * * * *